US006018920A

United States Patent [19]

Fancher

[11] Patent Number: 6,018,920

[45] Date of Patent: Feb. 1, 2000

[54] MODULAR PANEL ASSEMBLY SYSTEM

[76] Inventor: Hershel E. Fancher, 1524 Slate Run Rd., New Albany, Ind. 47150

[21] Appl. No.: 08/941,927

[22] Filed: Oct. 1, 1997

[51] Int. Cl.[7] ..... E04B 1/38; E04B 2/00

[52] U.S. Cl. ..... 52/582.2; 52/584.1; 52/240; 52/282.5; 52/270; 52/127.5; 52/127.9; 52/127.11; 52/741.1; 52/745.11; 52/745.14

[58] Field of Search ..... 52/582.1, 582.2, 52/584.1, 240, 127.9, 127.11, 741.1, 745.11, 745.14, 747.1, 127.5, 282.5, 270

[56] References Cited

U.S. PATENT DOCUMENTS 3,353,314 11/1967 Melcher ..... 52/582.2 X
3,769,768 11/1973 Bertrand ..... 52/127.5 X
5,134,826 8/1992 LaRoche et al. ..... 52/584.1

*Primary Examiner*—Robert Canfield
*Attorney, Agent, or Firm*—Don Halgren

[57] ABSTRACT

The present invention covers a modular panel assembly for the manufacture of a wall system from a plurality of thin modular wall panels of generally rectilinear configuration joined to one another. Each panel has an upper and a lower corner with a first corner block arranged on at least one of the corners of the modular panel. A tensile rod is pivotably disposed on the first corner block, and a cammed surface is arranged on the first corner block, so as to enable the first corner block to engagingly receive a tensile rod from a further corner block arranged on a further modular wall panel. One tensile rod from either one of two adjacent corner blocks on adjacent modular panels may secure the adjacent panels together in a secure and aligned manner.

18 Claims, 6 Drawing Sheets

MODULAR PANEL ASSEMBLY SYSTEM

Background of the Invention

1. Field of the Invention

The present invention relates to modular office partitions, and more particularly to arrangements for connecting adjacent partitions or modular panels together.

2. Prior Art

The assembly of modular office panels into a completed wall section is typically not user friendly. Often these panel systems are difficult to attach, requiring a lot of time plus special fasteners and connectors. Often these fasteners and connectors are missing from the shipment with the panels.

The prior art fails to provide an integral connector and panel arrangement which permits adjacent panels to be simply connected together in proper alignment without tools and complications.

It is therefore an object of the present invention, to provide a modular panel assembly arrangement which overcomes the disadvantages of the prior art.

It is a further object of the present invention, to provide a modular panel assembly arrangement with a universal connector arrangement already attached, unitary with each panel, to permit their ready attachment to an adjacent panel or to a rigid wall.

BRIEF SUMMARY OF THE INVENTION

The modern office environment is typically comprised of a plurality of office modules. Each office module is typically defined by a rectangular array of walls. Each of the walls are typically comprised of panels which may range from one to two inches thick, from four to six feet high, and from two to six feet in length. The present invention comprises a panel connecting system with a tensile connector arrangement permanently affixed thereon to permit adjacent panels to be readily attached to one another.

The tensile connector arrangement comprises a generally L-shaped corner block, having a first outer face and a second outer face. The first outer face of each corner block has a pair of chamfered holes for mounting the corner block to the corner of a panel, a chamfered pin extending therefrom for location in a mating block on an adjacent panel, and a chamfered locating hole to receive the chamfered pin of an opposing mating block. The second surface of the corner block has a pair of locking fingers thereon. Each locking finger has a side edge which is parallel to and lies in the plane of the first face of the corner block. Each finger has a ramp edge, and a cammed locking detent. Each second face also has a pair of retaining pivot hinges. A tensile connecting rod is attached to each pair of pivot hinges, each connecting rod having a first end joint, which joint is mated with each set of pivot hinges on each corner block.

Each tensile connecting rod comprises a generally elongated central portion having its transverse first end joint engaging the pivot hinges on its respective corner block. The tensile connecting rod has a second end with a corresponding second transverse end joint thereon as a locking arrangement. Each transverse joint has a bore extending therethrough.

The transverse locking joint on the second end of each tensile connecting rod is arranged to be pivoted into engagement over the fingers cammed surface on an adjacent corner block on an adjacent panel. The transverse locking joint first slides against the ramp on the distal end of each finger, and is pressed over the rounded detent, to snugly lock into and engage the cammed curvilinear portion of each finger with which it mates.

Since each upper and lower corner on each panel comes with its own corner block and its own tensile connecting rod, when two adjacent edges of adjacent panels are put together with their respective adjacent corner blocks abutting one another, one tensile corner connecting rod of one of the adjacent corner blocks, would merely be flipped rearwardly, (as being unnecessary for this particular adjacent panel), in the direction away from its adjacent corner block on its neighboring panel. Nonetheless, the arrangement of a tensile connecting rod with each corner block already mounted on each corner of each panel to be assembled, permits such ready assembly theretogether, while minimizing the missing parts problem often found in the prior art.

An extruded generally U-shaped channel member may be snapped over the top edge portions of the adjacent panels, to cover the corner blocks and connecting rods therebeneath.

In a further embodiment of the present invention, a rigid beam tensile rod may be extended perpendicular to a plate for attachment of a module panel to a wall, or attachment of a lower modular panel to a higher modular panel. The backing plate of the wall connector comprises a rectangular plate having holes for mounting the plate to the taller panel or to the wall. The tensile connector extending perpendicularly from the mounting plate has a transverse locking joint on its distal end. The locking joint is cylindrical in shape and transverse with respect to shaft body portion of the tensile connector. This locking plate and half tensile-connector rod permits a modular wall panel to be attached to a taller modular wall panel or to a wall itself in a manner similar to the aforementioned adjacent wall panels embodiment.

In yet a further embodiment of the present invention, when it is desired to join two modular wall panels or three modular wall panels at a corner, a generally L-shaped or T-shaped columnar module, as desired, is arranged at their intersection. The upper and lower ends of each columnar module have a transition connector corner block thereon. Each transition connector corner block is comprised of a first face similar to the first face of the aforementioned corner block, and has a second face perpendicular thereto, having only the finger portions extending therefrom. Thus the transition component receives the tensile connector rod from each adjacent panel attached thereto and there is no tensile connector used at this type of juncture.

It is further contemplated, that a assembly tool may be included to facilitate the articulation of a tensile connector rod into locking engagement with the cammed surface of the fingers of an adjacent corner block. The tool comprises a handle having a first or held end and a second or working end. The working end includes a pair of spaced-apart parallel pins, whose distance apart corresponds to the distance apart of the bores at each end of the locking joint of each tensile connecting rod. The pins of the tool are merely placed through the bores at each end of the tensile connecting rod, and the first end of the handle is pivoted so as to engage the transverse locking joint over the cammed edges at the appropriate set of fingers. Thus a pair of the panels are accurately and snugly engaged in tight and proper alignment with one another, with only the minimum number of tools required.

The present invention thus comprises a modular panel assembly for the manufacture of a wall system comprising a thin modular wall panel of generally rectilinear configuration. The panel has an upper and a lower corner. A first corner block is arranged on at least one of the corners of the modular panel. A tensile rod has a locking joint thereon, the tensile rod being pivotably disposed on the first corner block; and a cammed surface is arranged on the first corner block, so as to enable the first corner block to engagingly receive a locking joint of a tensile rod from a further corner block arranged on a further modular wall panel, wherein one tensile rod from either one of two adjacent corner blocks on adjacent modular panels may secure the adjacent panels together in a secure and aligned manner. An alignment pin and an alignment hole are arranged on a surface of the corner block, to permit proper alignment and engagement of the adjacent blocks and their respective panels theretogether. A finger arrangement extends from a surface of the first corner block, the finger arrangement including the cammed surface by which the locking joint of the tensile rod of a second corner block is engaged to an adjacent corner block of the first corner block. Each of the corner blocks are of "L" shape in cross-section, each of the corner blocks being mounted on an upper and a lower corner of each modular panel.

A columnar panel is arranged for joining two adjacent modular panels at an angle with respect to one another, the columnar panel having an upper end and a lower end, a modified corner block on at least one end thereof, the modified corner block having a cammed surface arranged on a surface thereof, so as to engagingly receive a locking joint of a tensile rod from a corner block arranged on an adjacent modular wall panel, wherein a tensile rod from the adjacent corner block on the adjacent modular panel may secure the columnar panel and the adjacent panels together, and similarly with a further modular panel, both of the modular panels being joined at an angle, in a secure and aligned manner. A "U" shaped cap may be arranged to snap onto and cover the corner blocks and tensile rods of adjacent modular panels.

The corner block may also comprise a tensile rod attached to a plate, the plate being attachable to a wall or further modular panel for engagement of the further tensile rod with the corner block of the first modular panel. The tensile rod may have an extension distal of the locking joint, to permit engagement of the locking joint of a first corner block on a first modular panel with the cammed surface of the fingers of a second corner block on a second modular panel there adjacent, without the need for tools to secure the engagement therebetween.

The invention also includes a method of attaching a plurality of modular panels together to form a wall system comprising the steps of: attaching a corner block with a hinge and a cam finger arrangement thereon, to the corner of a first modular panel; pivotally connecting a first tensile rod to an outward side of the corner block; placing the first modular panel adjacent a similarly configured second modular panel; flipping the first tensile rod pivotally attached to the corner blocks into engagement with a cam finger arrangement on the corner block of the second modular panel, so as to engage both of the modular panels together in a close fitting and aligned manner; flipping a tensile rod from the corner block of the second modular panel in a direction away from its adjacent corner block on the first modular panel, to avoid interference between the adjacent tensile rods; placing a locking joint on one end of the tensile rod, to permit the tensile rod of one corner block to lockingly engage a corner block of a further modular panel; providing the tensile rod with a pair of transverse bores; inserting a pivot handle having parallel pins thereon, into the pair of transverse bores to permit the tensile rod to be pivoted into cammed engagement with the corner block of the other modular panel; providing a distal extension on the tensile rod to provide a gripping portion to allow the tensile rod to be pivoted into cammed engagement with the corner block of the other modular panel without any tools; joining together a pair of modular panels at an angle, by interlocking a tensile rod from a corner block on each of the modular panels with a modified corner block on an intermediate columnar panel, to provide a rigid locking intersection therebetween; and wherein the second modular panel may comprise a wall, the corner block on the wall comprising a plate with a tensile rod extending rigidly therefrom, the rigid tensile rod extending from the plate on the wall and in locking engagement with the cammed finger arrangement on the block of the first modular panel.

The invention also includes a method of attaching a plurality of modular panels together to form a wall system comprising the steps of: placing a pivotable rod on a hinge on a corner of each modular panel to be joined together; placing a receiving finger on each corner of the modular panel, adjacent the pivotable rod; and swinging the pivotable rod from the corner of a first modular panel into locking engagement with the receiving finger on the corner of an adjacent second modular panel, so as to lock adjacent modular panels theretogether. The method may include attaching a locking joint on the distal end of the pivotable rod to permit the pivotable rod to lock onto the receiving finger without slipping therefrom, and extending the length of the rod beyond the locking joint to permit the rod to be readily pivoted into engagement with the receiving finger without any unnecessary tool.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
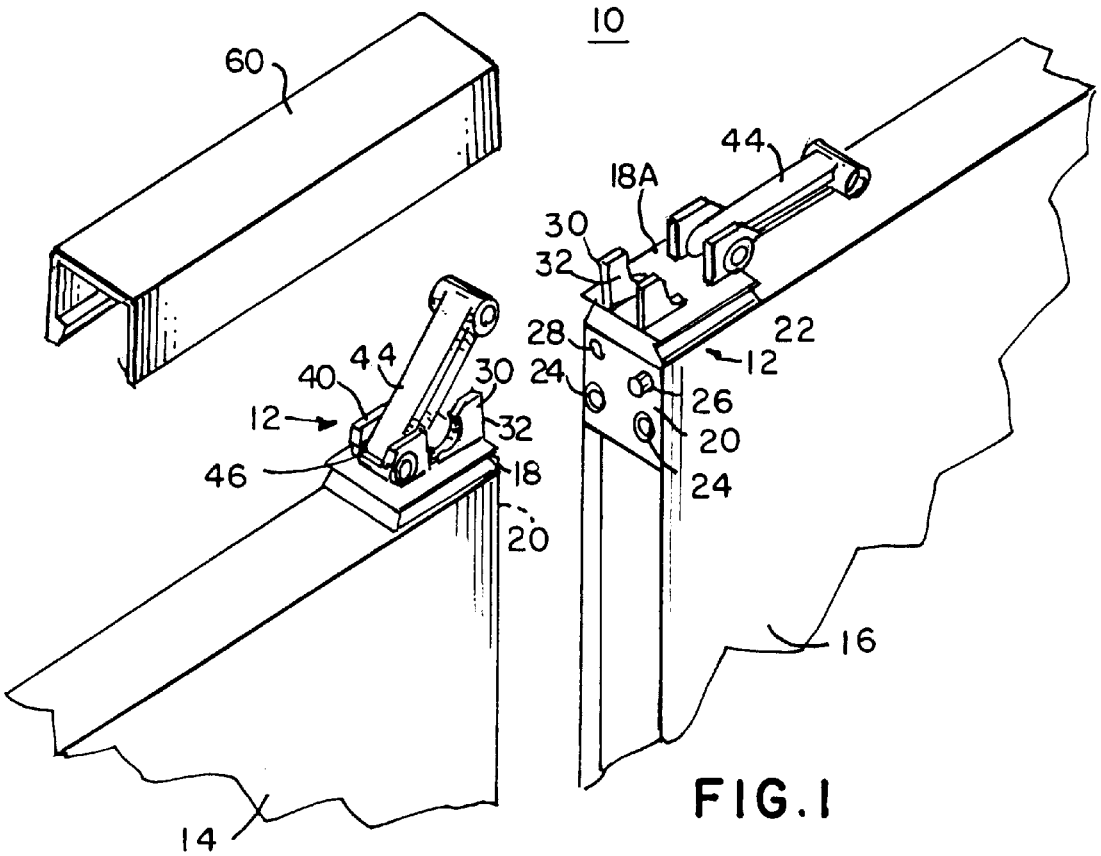
FIG. 1 is an exploded isometric view of a portion of adjacent panels having the locking assembly shown thereon.

Referring now to the drawings in detail, and particularly to FIG. 1, there is shown the present invention which comprises a panel connecting system 10 with a tensile connector arrangement 12 permanently affixed thereon to permit adjacent panels 14 and 16 to be readily attached to one another.

Figure 5A:
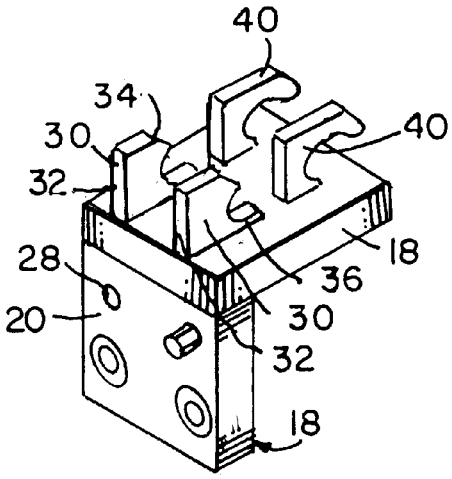
FIG. 5*a* and 5*b* show perspective views of corner blocks for mounting on a modular panel.
Figure 5B:
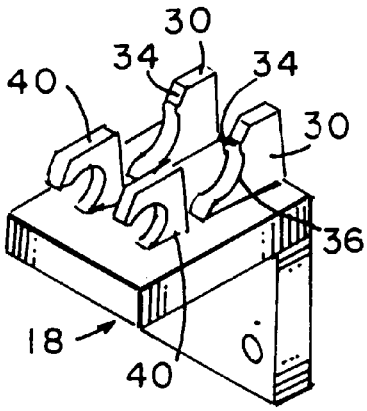

The tensile connector arrangement 12 comprises a generally L-shaped corner block 18, having a first outer surface 20 and a second outer surface 22. The first outer face 20 of each corner block 18 has a pair of chamfered holes 24 for mounting the corner block 18 to the corner of a panel 14 and 16, a chamfered pin 26 extending therefrom for location in a mating corner block 18A on an adjacent panel 16, and a chamfered locating hole 28 to receive the chamfered pin 26 of an opposing mating block 18. The second surface 22 of the corner block 18 has a pair of locking fingers 30 thereon, as shown in FIGS. 5*a* and 5*b*. Each locking finger pair 30 has a side edge 32 which is parallel to and lies in the plane of the first surface 20 of the first corner block 18. Each finger pair 30 has a ramp edge 34, and a cammed locking detent 36. Each second surface 22 also has a pair of retaining pivot hinges 40. A tensile connecting rod 44 is attached to each pair of pivot hinges 40, each connecting rod 44 having a first end joint 46, which joint end 46 is mated with each set of pivot hinges 40 on each corner block 18 and 18A.

Each tensile connecting rod 44 comprises a generally elongated central portion 48 having its transverse first end joint 46 engaging the pivot hinges 40 on its respective corner block 18. The tensile connecting rod 44 h as a second end with a corresponding second transverse end or locking joint 50 thereon as a locking arrangement. Each transverse joint 46 and 50 has a bore 52 extending therethrough.

The transverse locking joint 50 on the second end of each tensile connecting rod 44 is arranged to be pivoted into engagement over the fingers cammed surface 36 on an adjacent corner block 18A on an adjacent panel 16. The transverse locking joint 50 first slides against the ramp on the distal end of each finger, and is pressed over the rounded detent 36, to snugly lock into and engage the cammed curvilinear portion of each finger pair 30 with which it mates.

Since each upper and lower corner on each panel 14 and 16 comes with its own corner block 18 and 18A and its own tensile connecting rod 44, when two adjacent edges of adjacent panels 14 and 16 are put together with their respective adjacent corner blocks 18 and 18A abutting one another, one tensile corner connecting rod 44 of one of the adjacent corner blocks, would merely be flipped rearwardly, (as being unnecessary for this particular adjacent panel), in the direction away from its adjacent corner block 18A on its neighboring panel 16. Nonetheless, the arrangement of a tensile connecting rod 44 with each corner block 18 already mounted on each corner of each panel 14 and 16 to be assembled, permits such ready assembly theretogether, while minimizing the missing parts problem often found in the prior art.

An extruded generally U-shaped channel member 60, as shown in FIG. 1, may be snapped over the top edge portions of the adjacent panels 14 and 16, to cover the corner blocks 18 and 18A and connecting rods 44 therebeneath.

Figure 2:
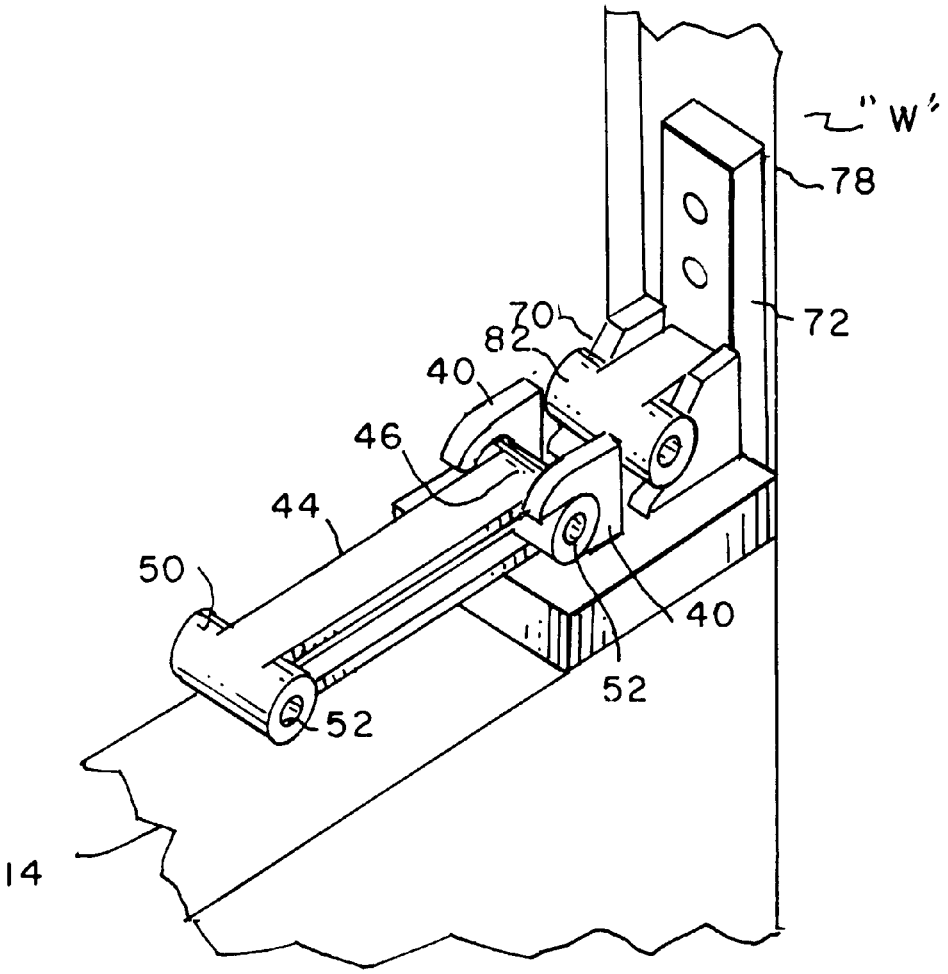
FIG. 2 is a perspective view of a corner of a first modular panel attached to a wall or higher module or panel in a further embodiment of the locking arrangement.
Figure 7:
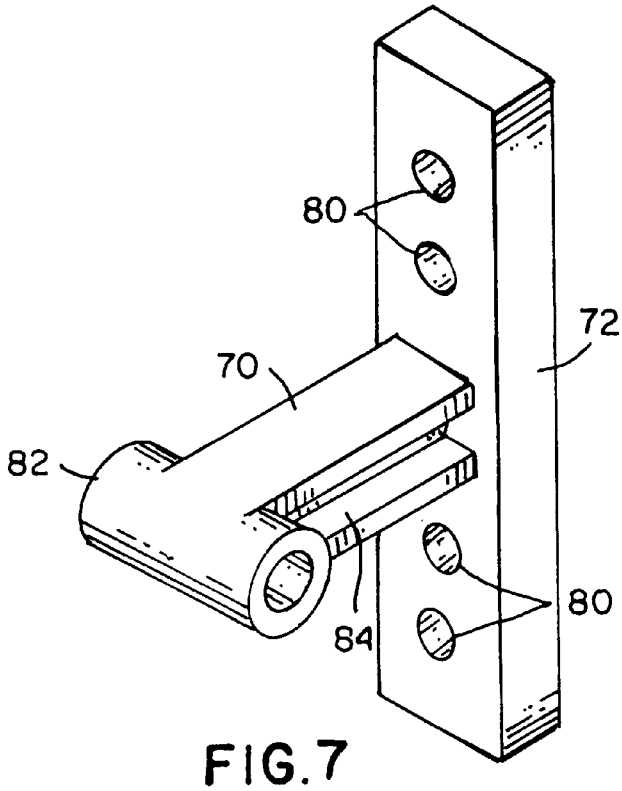
FIG. 7 shows a tensile rod and connector plate in a perspective view, which permits a modular panel to be attached to a wall or to a taller modular panel there adjacent.

In a further embodiment of the present invention, a rigid beam tensile rod 70 may be extended perpendicular from a plate 72, as shown in FIG. 7, for attachment of a module panel 74 to a wall "W", or attachment of a lower modular panel 74 to a higher modular panel 78, as shown in FIG. 2. The backing plate 72 of the wall connector comprises a rectangular plate having holes 80 for mounting the plate to the taller panel 78 or to the wall "W". The tensile connector rod 70 extending perpendicularly from the mounting plate 72 has a transverse locking joint 82 on its distal end. The locking joint 82 is cylindrical in shape and transverse with respect to shaft body portion 84 of the tensile connector rod 70. This locking plate 72 and half tensile-connector rod 70 permits a modular wall panel 74 to be attached to a taller modular wall 78 panel or to a wall "W" itself in a manner similar to the aforementioned adjacent wall panels embodiment.

Figure 3:
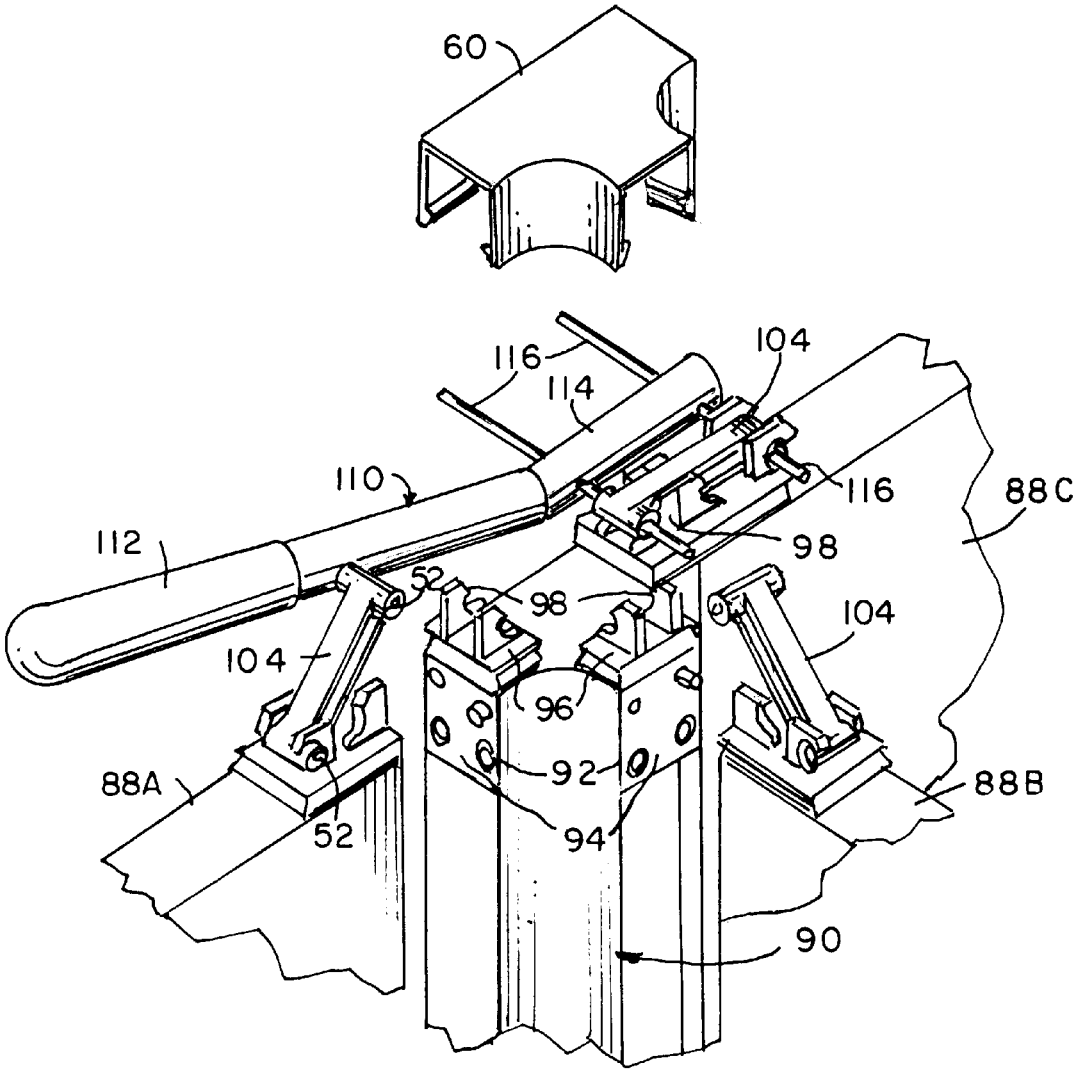
FIG. 3 is a perspective view of several panels joined at a corner with a corresponding columnar panel with its transition connector corner blocks thereon.
Figure 4:
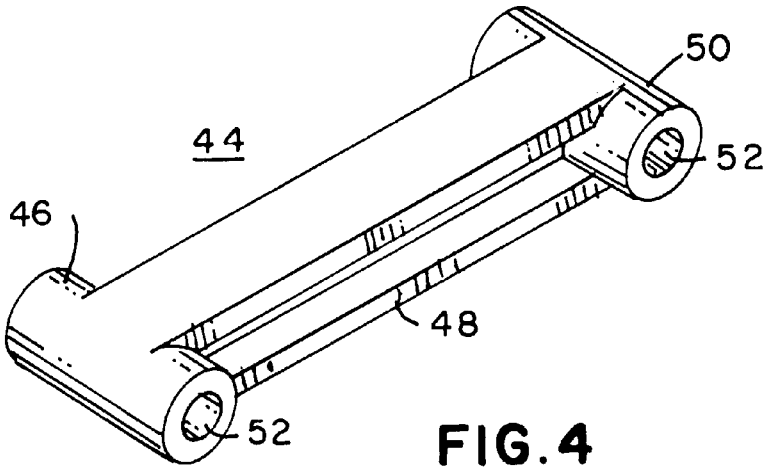
FIG. 4 is a perspective view of a tensile connection rod.
Figure 6B:
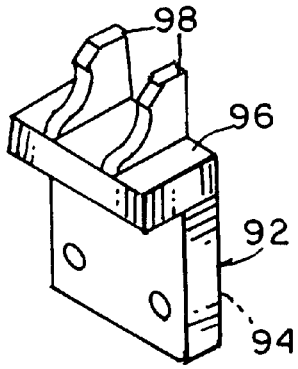
FIG. 6*a* through 6*c* show perspective views of transition connector corner blocks for the columnar panel.
Figure 6A:
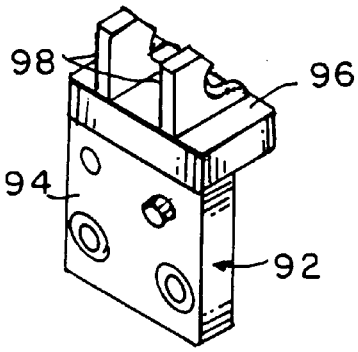
Figure 6C:
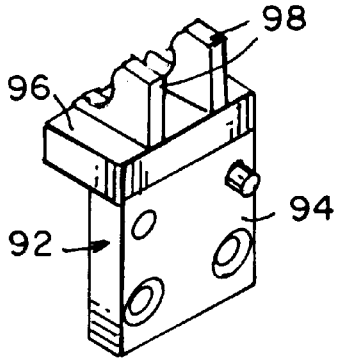

In yet a further embodiment of the present invention, when it is desired to join two modular wall panels 88A and 88B, or three modular wall panels 88A, 88B and 88C at a corner, as shown in FIG. 3, a generally L-shaped or T-shaped columnar module 90, as desired, is arranged at their intersection. The upper and lower ends of each columnar module 90 have a transition connector corner block 92 thereon, as may be seen in FIGS. 6*a*–6*c*. Each transition connector corner block 92 , is comprised of a first face 94 similar to the first face of the aforementioned corner block 18, and has a second face perpendicular 96 thereto, except it has only the finger portions 98 extending therefrom. Thus the transition component receives the tensile connector rod 104 from each adjacent panel 88A and 88B and 88C attached thereto and there is no extra unused tensile connector rod 104 used at this type of juncture, as there is in the aforementioned corner block 18.

Figure 8:
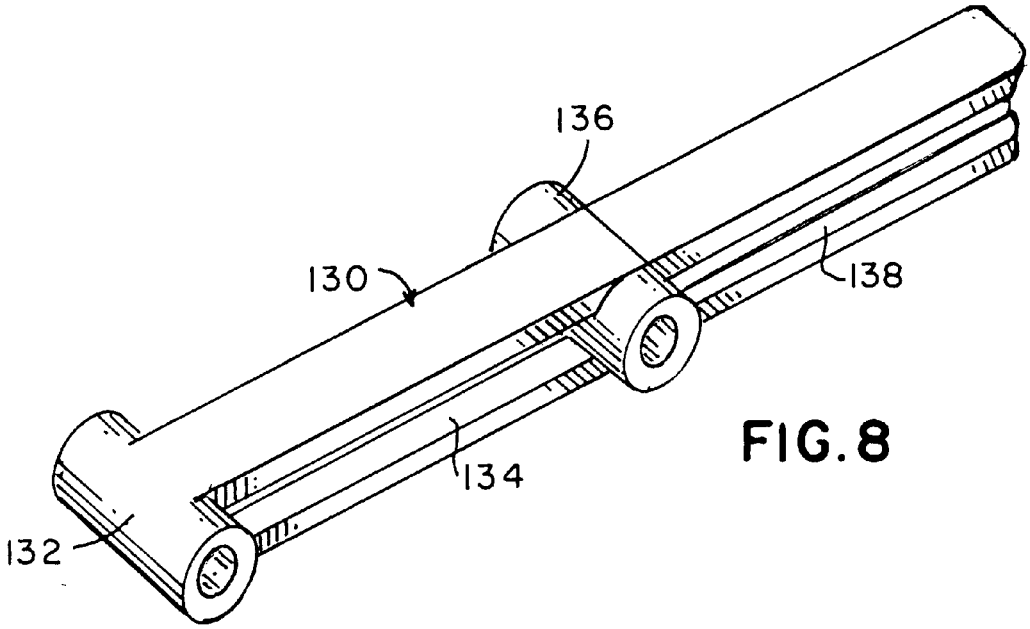
FIG. 8 shows a further embodiment of the tensile connector rod.

It is further contemplated, that a assembly tool 110, shown in FIG. 3, may be included to facilitate the articulation of a tensile connector rod 44 or 104, into locking engagement with the cammed surface of the fingers of an adjacent corner block. The tool 110 comprises a handle having a first or held end 112 and a second or working end 114. The working end 114 includes a pair of spaced apart parallel pins 116, whose distance apart corresponds to the distance apart of the bores 52 at each end of the locking joint of each tensile connecting rod 44. The pins 116 of the tool 110 are merely placed through the bores 52 at each end of the tensile connecting rod 44 or 104, and the first end 112 of the handle is pivoted so as to engage the transverse locking joint 50 over the cammed edges 34 at the appropriate set of fingers 30. A further embodiment of the tensile rod 130, is shown in FIG. 8, having a hinge joint 132, a central portion 134, a locking joint 136, and a distal extension 138 to permit the tensile rod 130 to be pivoted into locking engagement with the receiving fingers 30 of an adjacent corner block 12 without the need for any accessory tool. Thus a pair of the panels 18 and 18A may be accurately and snugly engaged in tight and proper alignment with one another, with only a minimum number of or no special tools required.

I claim:

1. A modular panel assembly for the manufacture of a wall system comprising:

a thin modular wall panel of generally rectilinear configuration, said panel having an upper and a lower corner;

a first corner block arranged on at least one of said corners of said modular panel;

a tensile rod with a locking joint thereon, said tensile rod being pivotably disposed on said first corner block; and a cammed surface arranged on said first corner block, so as to enable said first corner block to engagingly receive a locking joint of a tensile rod from a further corner block arranged on a further modular wall panel, wherein one tensile rod from either one of two adjacent corner blocks on adjacent modular panels may secure said adjacent panels together in a secure and aligned manner.

2. The modular panel assembly for the manufacture of a wall system as recited in claim 1, including:

an alignment pin and an alignment hole arranged on a surface of said corner block, to permit proper alignment and engagement of said adjacent blocks and their respective panels theretogether.

3. The modular panel assembly for the manufacture of a wall system as recited in claim 1, including:

a finger arrangement extending from a surface of said first corner block, said finger arrangement including said cammed surface.

4. The modular panel assembly for the manufacture of a wall system as recited in claim 1 wherein each of said corner blocks are of "L" shape in cross-section, each of said corner blocks being mounted on an upper and a lower corner of each modular panel.

5. The modular panel assembly for the manufacture of a wall system as recited in claim 1, including a columnar panel for joining two adjacent modular panels at an angle with respect to one another, said columnar panel having an upper end and a lower end, a modified corner block on at least one said end, said modified corner block having a cammed surface arranged on a surface thereof, adapted to engagingly receive a locking joint of a tensile rod from a corner block arranged on an adjacent modular wall panel, wherein a tensile rod from said adjacent corner block on said adjacent modular panel may secure said columnar panel and said adjacent panels together, and similarly with a further modular panel, both of said modular panels being joined at an angle, in a secure and aligned manner.

6. The modular panel assembly for the manufacture of a wall system as recited in claim 1, including a "U" shaped cap arranged to snap onto and cover said corner blocks and tensile rods of adjacent modular panels.

7. The modular panel assembly for the manufacture of a wall system as recited in claim 1, wherein said further corner block comprises a tensile rod attached to a plate, said plate being attachable to a wall or further modular panel for engagement of said further tensile rod with said corner block of said first modular panel.

8. The modular panel assembly for the manufacture of a wall system as recited in claim 1, wherein said tensile rod has an extension distally of said locking joint, to permit engagement of said locking joint of a first corner block on a first modular panel with said cammed surface of said fingers of a second corner block on a second modular panel thereadjacent, without the need for tools to secure the engagement therebetween.

9. A method of attaching a plurality of modular panels together to form a wall system comprising the steps of:

attaching a corner block with a hinge and a cam finger arrangement thereon, to the corner of a first modular panel;

pivotally connecting a first tensile rod to an outward side of said corner block;

placing said first modular panel adjacent a similarly configured second modular panel;

flipping said first tensile rod pivotally attached to said corner blocks into engagement with a cam finger arrangement on the corner block of said second modular panel, so as to engage both of said modular panels together in a close fitting and aligned manner.

10. The method of attaching a plurality of modular panels together to form a wall system as recited in claim 9, including the step of:

flipping a tensile rod from said corner block of said second modular panel in a direction away from its adjacent corner block on said first modular panel, to avoid interference between the adjacent tensile rods.

11. The method of attaching a plurality of modular panels together to form a wall system as recited in claim 9, including the step of:

placing a locking joint on one end of said tensile rod, to permit said tensile rod of one corner block to lockingly engage a corner block of a further modular panel.

12. The method of attaching a plurality of modular panels together to form a wall system as recited in claim 11, including the steps of:

providing said tensile rod with a pair of transverse bores;

inserting a pivot handle having parallel pins thereon, into said pair of transverse bores to permit said tensile rod to be pivoted into cammed engagement with said corner block of said other modular panel.

13. The method of attaching a plurality of modular panels together to form a wall system as recited in claim 11, including the step of:

providing a distal extension on said tensile rod to provide a gripping portion to allow said tensile rod to be pivoted into cammed engagement with said corner block of said other modular panel without any tools.

14. The method of attaching a plurality of modular panels together to form a wall system as recited in claim 11, including the step of:

joining together a pair of modular panels at an angle, by interlocking a tensile rod from a corner block on each of said modular panels with a modified corner block on an intermediate columnar panel, to provide a rigid locking intersection therebetween.

15. The method of attaching a plurality of modular panels together to form a wall system as recited in claim 11, wherein said second modular panel comprises a wall, said corner block on said wall comprising a plate with a tensile rod extending rigidly therefrom, said rigid tensile rod extending from said plate on said wall and in locking engagement with said cammed finger arrangement on said block of said first modular panel.

16. A method of attaching a plurality of modular panels together to form a wall system comprising the steps of:

placing a pivotable rod on a hinge on a corner of each modular panel to be joined together;

placing a receiving finger on each corner of said modular panel, adjacent said pivotable rod; and swinging the pivotable rod from the corner of a first modular panel into locking engagement with the receiving finger on the corner of an adjacent second modular panel, so as to lock adjacent modular panels theretogether.

17. The method of attaching a plurality of modular panels together to form a wall system, as recited in claim 16, comprising the step of:

attaching a locking joint on the distal end of said pivotable rods to permit said pivotable rods to lock onto said receiving fingers without slipping therefrom.

18. The method of attaching a plurality of modular panels together to form a wall system, as recited in claim 17, comprising the step of:

extending the length of said rods beyond said locking joints to permit said rods to be readily pivoted into engagement with said receiving fingers without any unnecessary tool.

* * * * *